US005327809A

United States Patent [19]

Matteson et al.

[11] Patent Number: 5,327,809

[45] Date of Patent: Jul. 12, 1994

[54] DUAL PACK CANISTER

[75] Inventors: Philip L. Matteson; White Bear Lake; Stan P. Bovee, St. Cloud; Aye Kung, Coon Rapids, all of Minn.

[73] Assignee: FMC Corporation, Chicago, Ill.

[21] Appl. No.: 36,569

[22] Filed: Mar. 24, 1993

[51] Int. Cl.[5] ..... F41F 3/04

[52] U.S. Cl. ..... 89/1.817; 89/1.816

[58] Field of Search ..... 89/1.809, 1.810, 1.812, 89/1.814, 1.816, 1.817, 1.818

[56] References Cited

U.S. PATENT DOCUMENTS

| | | | |
|---|---|---|---|
| 2,792,962 | 5/1957 | Granfelt | 89/1.816 |
| 2,844,073 | 7/1958 | Re et al. | 89/1.817 |
| 3,185,035 | 5/1965 | Gregory-Humpheries | 89/1.818 |
| 3,221,602 | 12/1965 | Price et al. | 89/1.810 |
| 3,245,318 | 4/1966 | Finklestein et al. | 89/1.809 |
| 3,266,373 | 8/1966 | Brown | 89/1.816 |
| 3,289,533 | 12/1966 | Brown | 89/1.810 |
| 3,319,522 | 5/1967 | Gould | 89/1.816 |
| 3,367,235 | 2/1968 | Andrews | 89/1.816 |
| 3,708,563 | 1/1973 | Sells | 89/1.816 |
| 3,710,678 | 1/1973 | Abelin et al. | 89/1.816 |
| 3,718,070 | 2/1973 | Schneider, Jr. | 89/1.816 |
| 3,750,529 | 8/1973 | Reed et al. | 89/1.816 |
| 3,754,497 | 8/1973 | Rusbach | 89/1.816 |
| 3,841,197 | 10/1974 | Morrisey | 89/1.816 |
| 3,988,961 | 11/1976 | Banta | 89/1.816 |
| 4,077,922 | 3/1978 | Farrissey, Jr. et al. | 260/2.5 N |
| 4,079,162 | 3/1978 | Metzger | 428/312 |
| 4,296,669 | 10/1981 | Debona et al. | 89/1.816 |
| 4,301,708 | 11/1981 | Mussey | 89/1.810 |
| 4,324,167 | 4/1982 | Piesik | 89/1.8 |
| 4,336,740 | 6/1982 | Leigh | 89/1.816 |
| 4,342,252 | 8/1982 | Hagelberg et al. | 89/1.817 |
| 4,389,054 | 6/1983 | Lee | 277/215 |
| 4,399,999 | 8/1983 | Wold | 89/1.816 |
| 4,406,211 | 9/1983 | Andersen | 89/1.809 |
| 4,430,942 | 2/1984 | Heyman | 89/1.819 |
| 4,464,972 | 8/1984 | Simon | 89/1.816 |
| 4,470,336 | 9/1984 | Swann et al. | 89/1.816 |
| 4,492,143 | 1/1985 | Ruhle | 89/1.810 |
| 4,498,368 | 2/1985 | Doane | 89/1.817 |
| 4,602,552 | 7/1986 | Steinmetz, Jr. | 89/1.816 |
| 4,604,939 | 8/1986 | Hoffmeister | 89/1.816 |
| 4,604,940 | 8/1986 | Mendelsohn et al. | 89/1.816 |
| 4,627,327 | 12/1986 | Huber | 89/1.816 |
| 4,646,617 | 3/1987 | Robinson | 89/1.816 |
| 4,734,329 | 3/1988 | Rudd et al. | 89/1.816 |
| 4,739,027 | 4/1988 | Mendelsohn et al. | 89/1.816 |
| 4,934,241 | 6/1990 | Piesik | 89/1.817 |
| 4,970,937 | 11/1990 | Ward | 89/1.817 |
| 5,115,711 | 5/1992 | Bushagour et al. | 89/1.816 |
| 5,136,922 | 8/1992 | Piesik | 89/1.816 |
| 5,162,605 | 11/1992 | Piesik | 89/1.817 |
| 5,220,125 | 6/1993 | Huber | 89/1.816 |

*Primary Examiner*—David H. Brown

*Attorney, Agent, or Firm*—Michael Lee; R. C. Kamp; R. B. Megley

[57] ABSTRACT

The invention provides a canister which holds two missiles, which is the same size as prior art canisters that held a single missile. The inventive canister provides improved structural strength, simpler operation for the closure and electronics and an improved shock isolation system. The improved structure uses tubes and a lattice structure. The closure is hinged and uses gravity or the missile blast to complete closing. The electronics uses a flip flop switch. The shock isolation system utilizes urethane pads with apertures or air pockets and a silicon coating.

10 Claims, 5 Drawing Sheets

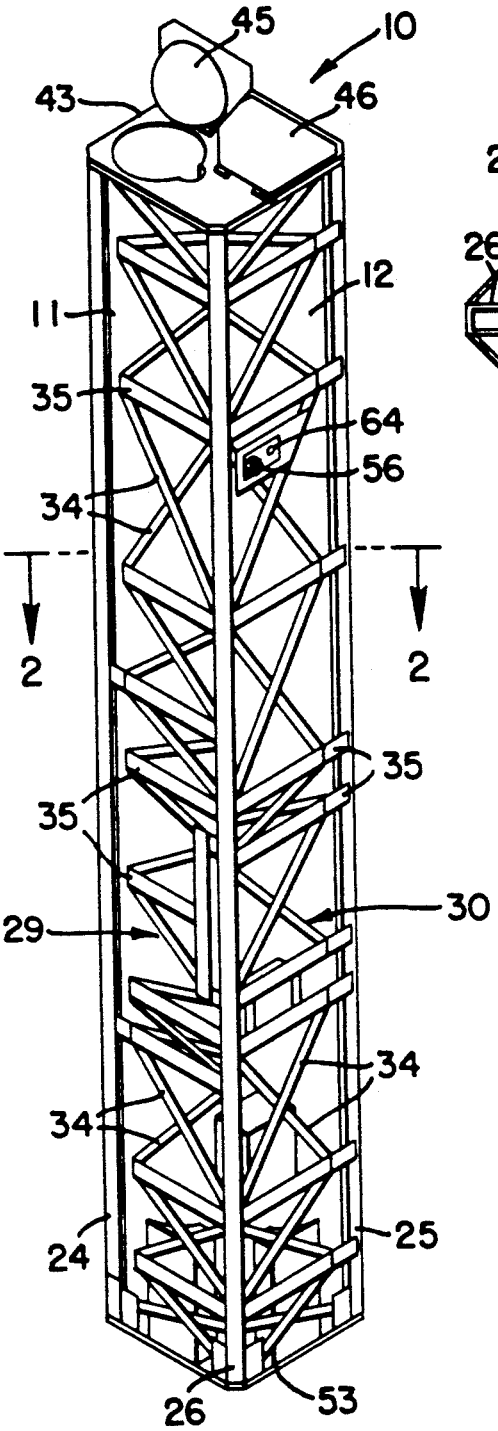
FIG_1
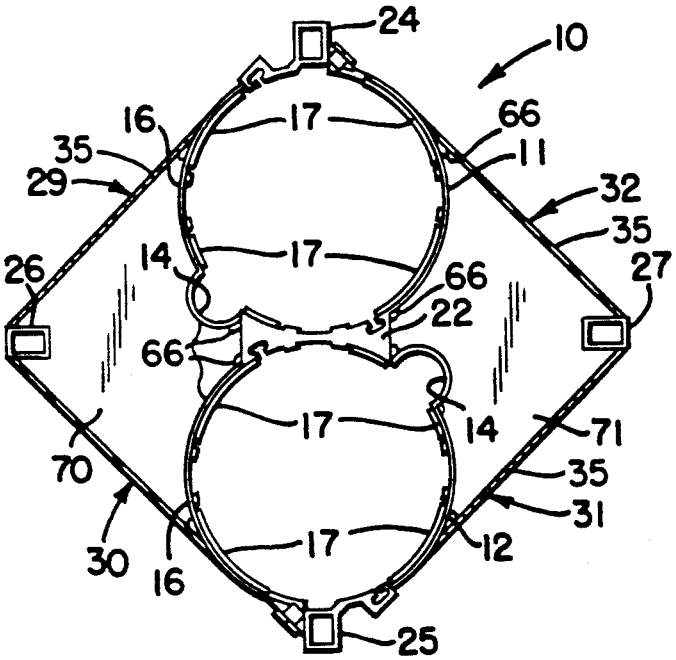
FIG_2
FIG_3A
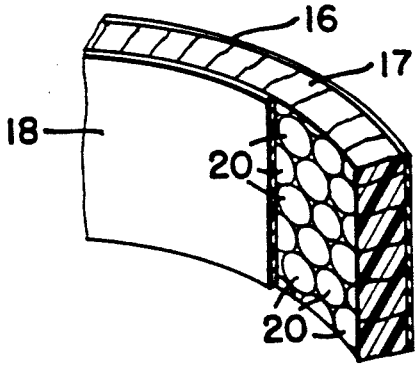
FIG_3B
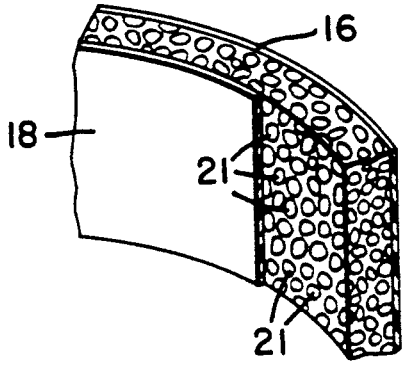

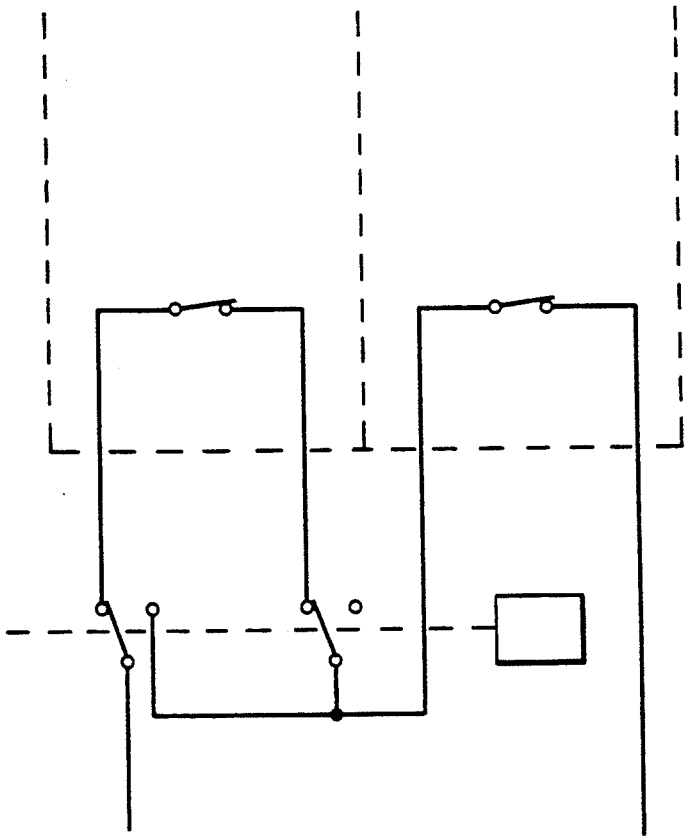
FIG_8
FIG_9
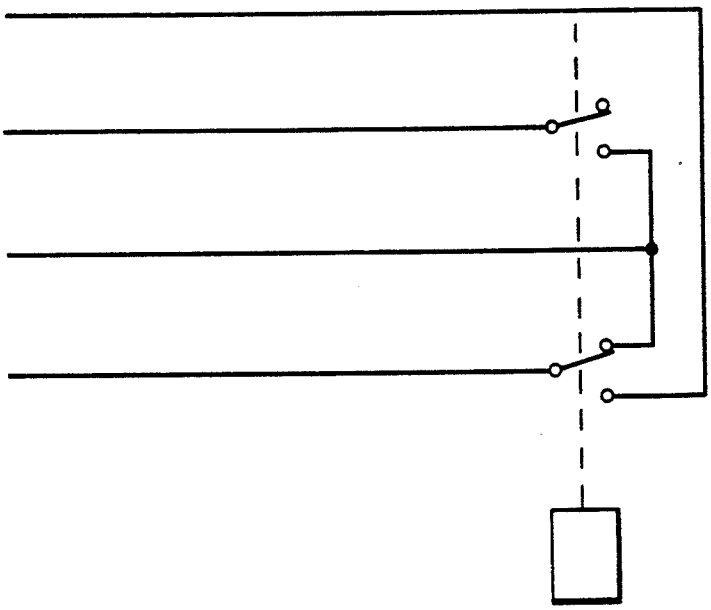

DUAL PACK CANISTER

The invention provides a canister which holds two missiles, which is the same size as prior art canisters that held a single missile. The inventive canister employs alternative structural methods, enhanced operation for the forward closures, a new approach to the electrical system, and an improved shock isolation system employing novel materials and method of manufacturing.

FIG. 1 is a perspective view of a dual pack canister.

FIG. 2 is a cross sectional view of the dual pack canister taken along lines 2—2 of FIG. 1.

FIG. 3A is a cut away view of a shock isolation pad.

FIG. 3B is another embodiment of a shock isolation pad.

FIGS. 7 to 9 are circuit configurations which are equivalent to the circuit configuration illustrated in FIG. 6, which may be used in the dual pack electrical system.

Figure 4:
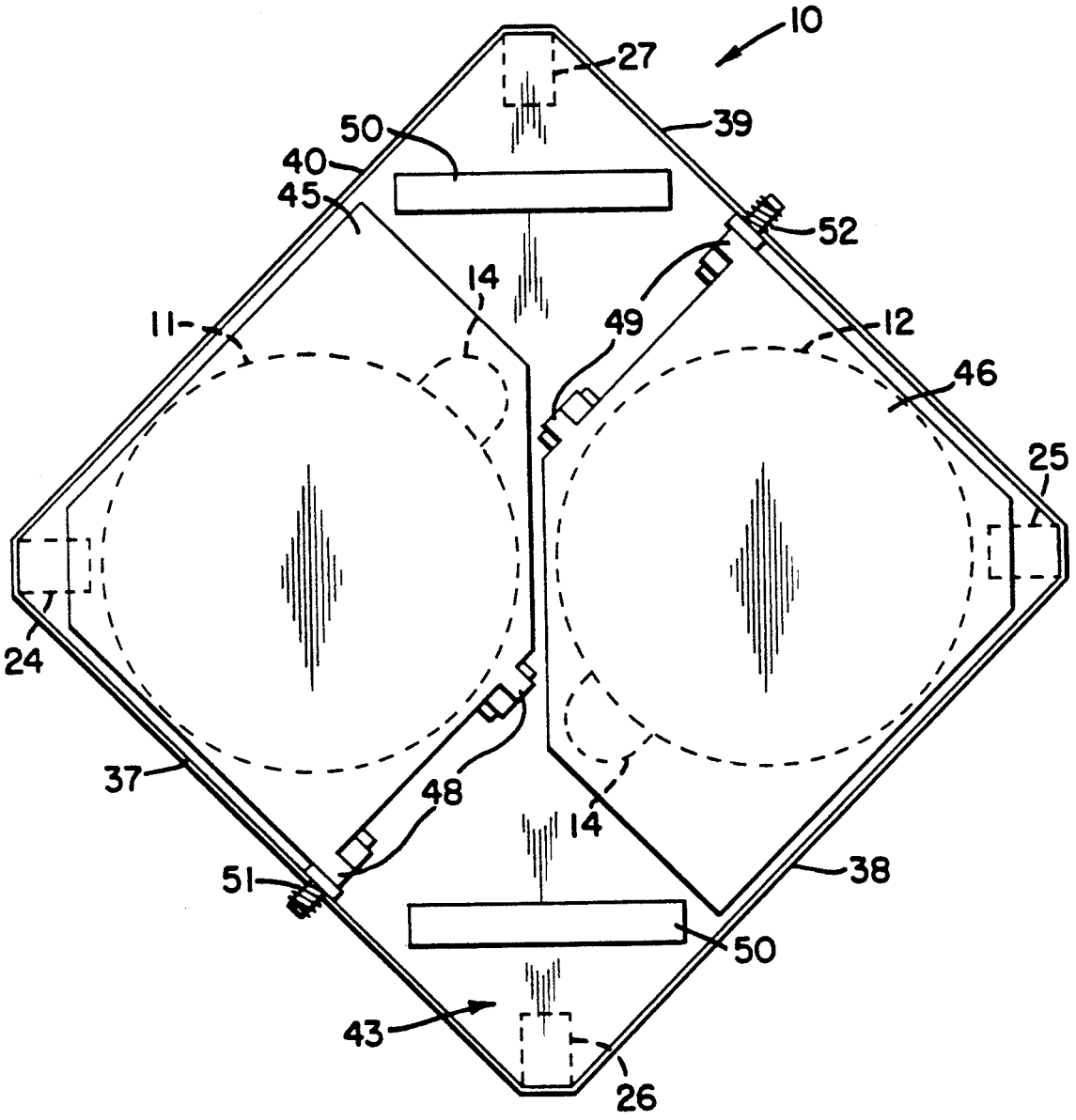
FIG. 4 illustrates the forward closure of the dual pack canister.

FIG. 1 is a perspective view of a dual pack canister 10 used in a preferred embodiment of the invention. FIG. 2 is a cross sectional view of the dual pack canister 10. The canister 10 utilizes a first missile tube 11 and a second cylindrical missile tube 12. The first and second missile tubes 11, 12 in the preferred embodiment have a generally circular cross-section with a structural pocket 14, to accommodate an infrared (IR) seeker device on the missile. The missile tube comprises an outer shell 16 formed by a tube of stiff material, a shock isolation pad 17 forming a tube lining the inside of the outer shell 16, and an inner tube 18 lining the inside of the shock isolation pad 17. FIG. 3 illustrates fragmentary view of a part of a missile tube. In the preferred embodiment of the invention, the outer shell 16 may be made of metal or composite material. The shock isolation pads 17 are cellular urethane sheet material with apertures and are adhesively bonded or mechanically fastened inside the outer shells 16. The apertures 20 are shaped as shown to form a honeycomb. In another embodiment of the invention, the apertures 20 can be replaced with air pockets, 21 which may be formed by large bubbles in the urethane. Other soft materials may be used in the place of urethane. The inner tube 18 is made of a silicon coat, which reduces friction.

A center structure 22 is mechanically connected between the outer shells 16 of the first missile tube 11 and the second missile tube 12, mechanically connecting the first missile tube 11 to the second missile tube 12. In the preferred embodiment, the center structure 22 is made of an extruded or formed metal or pultruded or laid up composite material.

Hollow bars forming a first longeron 24, a second longeron 25, a third longeron 26, and a fourth longeron 27 with lengths that extend substantially along the length to the first and second missile tubes 11, 12 are placed around the first and second missile tubes 11, 12 as shown so that they are substantially parallel to the first and second missile tubes 11, 12 and are at the canister corners. The first longeron 24 is placed adjacent to the first missile tube 11 and is mechanically connected to the first missile tube 11. The second longeron 25 is placed adjacent to the second missile tube 12 and is mechanically connected to the second missile tube 11. The third and fourth longerons 26, 27 are spaced apart from the first and second missile tubes 11, 12, so that the third and fourth longerons 26, 27 and the center structure 22 lie on a common plane. The first, second, third, and fourth longerons 24, 25, 26, 27 are made of a stiff material such as an extruded or formed metal or pultruded or laid up composite material.

A first lattice 29 mechanically connects the first missile tube 11 with the third longeron 26. A second lattice 30 mechanically connects the second missile tube 12 with the third longeron 26. A third lattice 31 mechanically connects the second missile tube 12 with the fourth longeron 27. A fourth lattice 32 mechanically connects the first missile tube 11 with the fourth longeron 27. The first, second, third, and fourth lattices 29, 30, 31, 32 are formed by stiff linear pieces of material forming diagonal struts 34 forming a criss-cross, and horizontal struts 35 perpendicular to the lengths of the longerons 24–27. The first, second, third, and fourth lattices 29, 30, 31, 32 form a square tube shape. The diagonal struts 34 and horizontal struts 35 of the first lattice 29 extend from the third longeron 26 to a part of the first missile tube 11 which is tangent to the diagonal struts 34, with the ends of the diagonal struts 34 and the horizontal struts 35 being mechanically connected to the third longeron 26 and the first missile tube 11. The diagonal struts 34 and horizontal struts 35 of the second lattice 30 extend from the third longeron 26 to a part of the second missile tube 12 which is tangent to the diagonal struts 34, with the ends of the diagonal struts 34 and the horizontal struts 35 being mechanically connected to the third longeron 26 and the second missile tube 12. The diagonal struts 34 and horizontal struts 35 of the third lattice 31 extend from the fourth longeron 27 to a part of the second missile tube 12 which is tangent to the diagonal struts 34, with the ends of the diagonal struts 34 and the horizontal struts 35 being mechanically connected to the fourth longeron 27 and the second missile tube 12. The diagonal struts 34 and horizontal struts 35 of the fourth lattice 32 extend from the fourth longeron 27 to a part of the first missile tube 11 which is tangent to the diagonal struts 34, with the ends of the diagonal struts 34 and the horizontal struts 35 being mechanically connected to the fourth longeron 27 and the first missile tube 11.

A first plurality of lateral connecting plates 70 extend perpendicularly from horizontal struts 35 and the third longeron 26 internally of the canister 10 to the first and second missile tubes 11 and 12. The first plurality of lateral connecting plates 70 are mechanically connected to the horizontal struts 35, the third longeron 26, and the first and second missile tubes 11 and 12. A second plurality of lateral connecting plates 71 are mechanically connected to the horizontal struts 35, the fourth longeron 27, and the first and second missile tubes 11 and 12. The first and second plurality of lateral connecting plates 70, 71 are made of a stiff material such as formed metal or laid up composite material.

As shown in FIG. 4 a first sheet 37 is mechanically connected to the horizontal struts 35 of the first lattice 29, the third longeron 26, and the first missile tube 11. A second sheet 38 is mechanically connected to the horizontal struts 35 of the second lattice 30, the third longeron 26, and the second missile tube 12. A third sheet 39 is mechanically connected to the horizontal struts 35 of the third lattice 31, the fourth longeron 27, and the second missile tube 12. A fourth sheet 40 is mechanically connected to the horizontal struts 35 of the fourth lattice 32, the fourth longeron 27, and the first missile tube 11. The first, second, third, and fourth sheets 37, 38, 39, 40 form a square tube which make the sides of the dual pack canister 10. In the preferred embodiment the sheets are a metal or fiberglass material and are constructed to shield the canister internal area from electromagnetic interference. The sheets are not shown in FIG. 1 to allow a complete view of the latices.

The dual pack canister 10 has a forward end 43 and an aft end 53. A forward end 43 is shown in FIG. 4. The forward end 43 has a first closure 45 and a second closure 46. The first closure 45 covers the first missile tube 11. The first closure 45 is mechanically connected to a forward end plate 43 by a first plurality of hinges 48, which allow the first closure 45 to open and close and reseal. A first spring 51 is mechanically connected to the first plurality of hinges 48 to facilitate the closing of the first closure 45. Other types of memory material may replace the first spring 51. The second closure 46 is mechanically connected to the forward end plate 43 by a second plurality of hinges 49, which allows the second closure 46 to open and close and reseal. A second spring 52 is mechanically connected to the second plurality of hinges 49 to facilitate the closing of the second closure 46.

The aft closure 53 may be a conventional aft closure as used in other missile canister systems.

Figure 5:
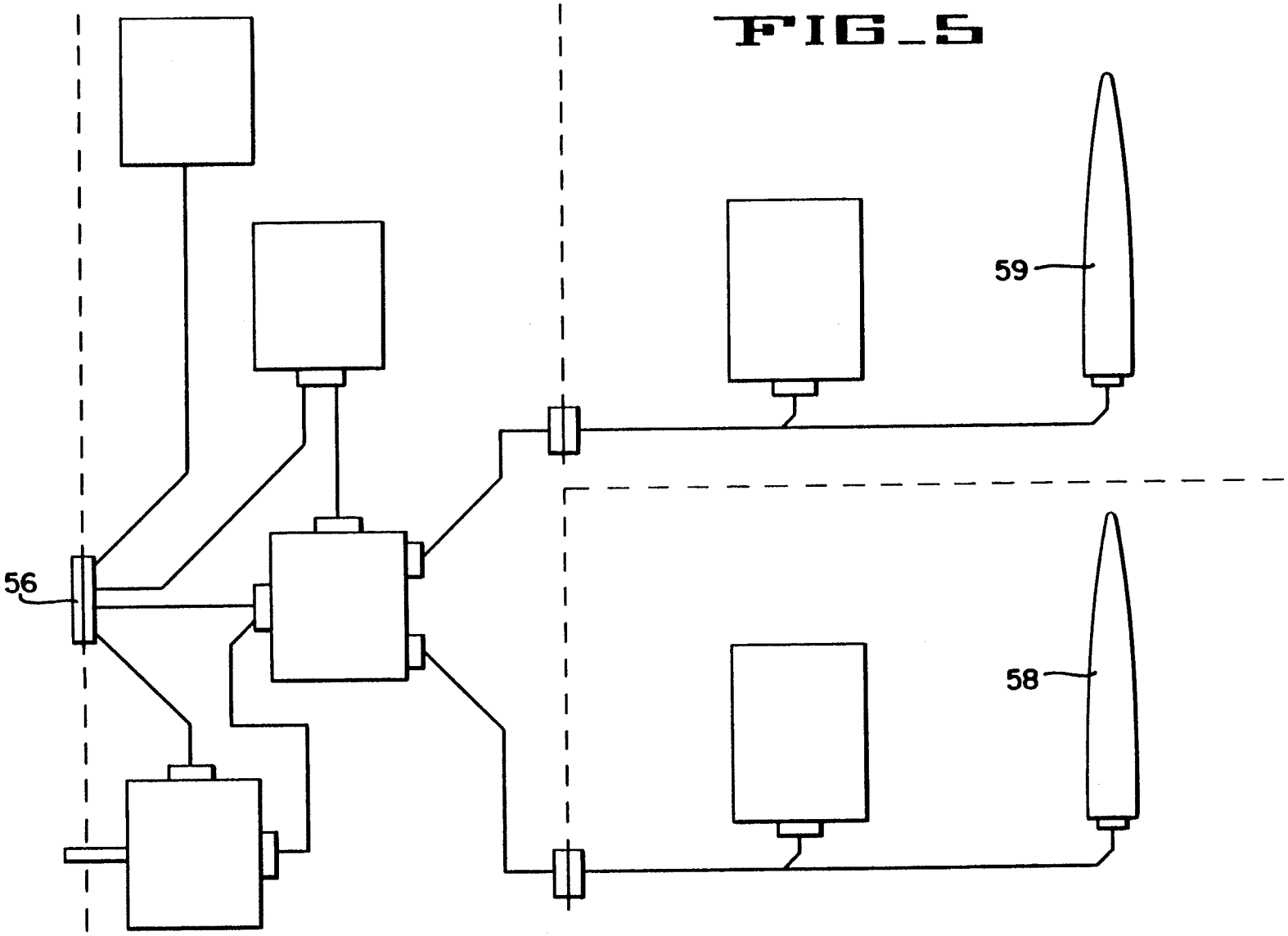
FIG. 5 is a schematic of the electrical system of the dual pack canister which employs a flip-flop switch.
Figure 6:
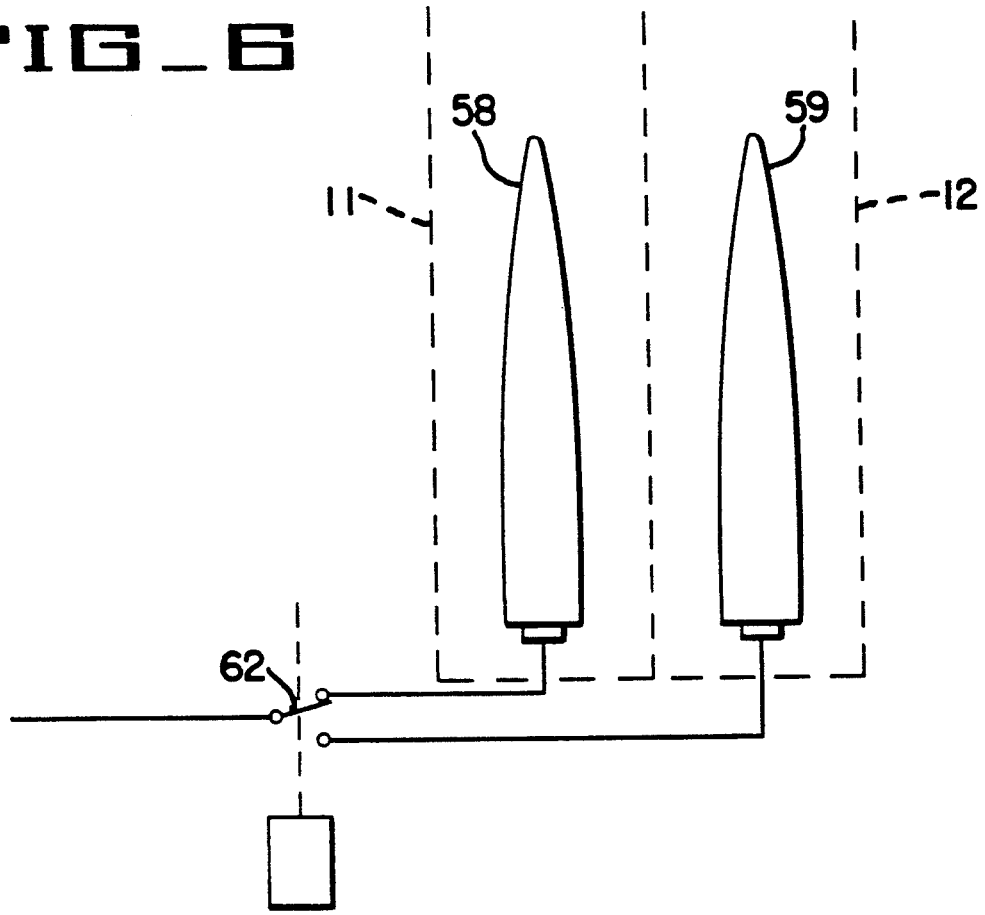
FIG. 6 is a more detailed electrical schematic of circuit configurations in the dual pack electrical system.
Figure 7:
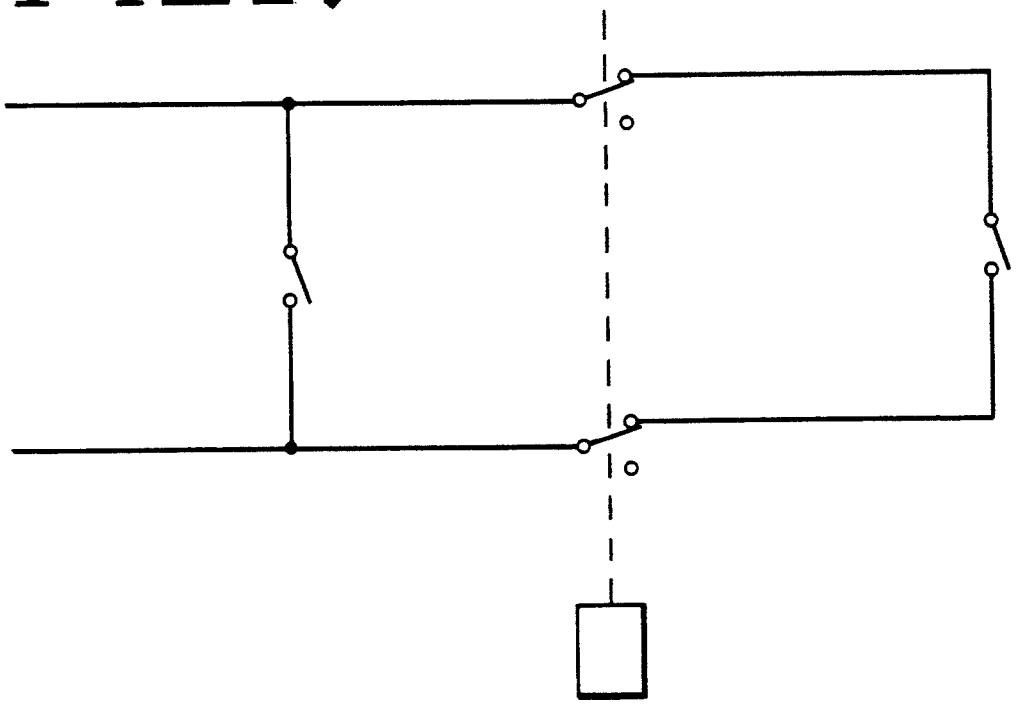

Electrical cabling is attached to the dual pack canister through a first electrical connector 56. FIG. 5 is an schematic of the electrical system of the dual pack canister. The electrical connector 56 is electrically connected to a first missile 58 and a second missile 59 through a flip-flop switch 62. FIG. 6 is a schematic of a flip-flop switch 62. FIGS. 7 through 9 are schematics of electrical circuits that may be used in place of the electrical circuit in FIG. 6. A safe and enable switch 64 is located adjacent to the electrical connector 56.

In operation, the first and second missiles 58, 59 are stored in the first and second missile tubes 11, 12 respectively. The dual pack canister 10 is loaded on a ship and the electrical control and power from the ship is connected to the dual pack canister 10 through the first electrical connector 56. The safe and enable switch 64 is set from the safe to the enable position before firing. The flip flop switch 62 provides launching signals only to the first missile 58. Other electrical information does not pass through the flip flop switch 62, so that the second missile 59 may be monitored while the flip flop switch is open with respect to the second missile 59 and closed with respect to the first missile 61 as shown in FIG. 6. The control system from the ship causes the first missile 58 to launch. The first missile 58 pushes the first forward closure 45 open. The shock isolation pad 17 minimizes the shock traveling to the first missile 58 from the ship. The inner tube 18 allows the first missile 58 to easily slide out of the first missile tube 11. Once the first missile 58 has exited the first missile tube 11, the first forward closure begins to pull toward a close position so that gravity and/or exhaust from the first missile 58 cause the first forward closure 45 to close and seal. The flip-flop switch 62 then opens for the first missile 58 and closes for the second missile 59, allowing launch related signals to pass to the second missile 59. The control system from the ship causes the second missile 59 to launch. The second missile 59 pushes the second forward closure 46 open. The shock isolation pad 17 minimizes the shock traveling to the outside of the second missile tube 12. The inner tube 18 allows the second missile 59 to easily slide out of the second missile tube 12. Once the second missile 59 has exited the second missile tube 12, the second forward closure begins to pull toward a close position so that gravity and/or exhaust from the second missile 59 cause the second forward closure 46 to close and seal.

In the specification and claims, one item may be mechanically connected to another by mechanical fasteners or by welds 66, as shown in FIG. 2, or by the use of an adhesive to establish adhesive bonding.

While preferred embodiment of the present invention has been shown and described herein, it will be appreciated that various changes and modifications may be made therein without departing from the spirit of the invention as defined by the scope of the appended claims.

What is claimed is:

1. An apparatus for holding a first missile and a second missile, comprising:

a first missile tube with a length, a central support mechanically connected to a first side of the first missile tube along the length of the first missile tube;

a second missile tube mechanically connected on a first side of the second missile tube to the central support along the length of the central support;

a first longeron spaced apart from the first missile tube and the second missile tube, wherein the first longeron has a length that is substantially parallel to the length of the first missile tube and the length of the second missile tube;

a second longeron spaced apart from the first missile tube, the second missile tube, and the first longeron, wherein the second longeron has a length that is substantially parallel to the length of the first missile tube and the length of the second missile tube;

a first lattice mechanically connected between a second side of the first missile tube along the length of the first missile tube and the first longeron along the length of the first longeron;

a second lattice mechanically connected between a second side of the second missile tube along the length of the second missile tube and the first longeron along the length of the first longeron;

a third lattice mechanically connected between a third side of the second missile tube along the length of the second missile tube and the second longeron along the length of the second longeron; and a fourth lattice mechanically connected between a third side of the first missile tube along the length of the first missile tube and the second longeron along the length of the second longeron.

2. An apparatus, as claimed in claim 1:

wherein the first lattice, comprises:

a plurality of diagonal struts mechanically connected between the first longeron and the first missile tube, and wherein the diagonal struts are placed in a criss-cross pattern, and wherein ends of the diagonal struts are mechanically connected to the first longeron and the first missile tube; and a plurality of horizontal struts mechanically connected to the first longeron and the first missile tube;

wherein the second lattice, comprises:

a plurality of diagonal struts mechanically connected between the first longeron and the second missile tube, and wherein the diagonal struts are placed in a criss-cross pattern, and wherein ends of the diagonal struts are mechanically connected to the first longeron and the second missile tube; and a plurality of horizontal struts mechanically connected to the first longeron and the second missile tube;

wherein the third lattice, comprises:

a plurality of diagonal struts mechanically connected between the second longeron and the second missile tube, and wherein the diagonal struts are placed in a criss-cross pattern, and wherein ends of the diagonal struts are mechanically connected to the second longeron and the second missile tube; and a plurality of horizontal struts mechanically connected to the second longeron and the second missile tube; and wherein the fourth lattice, comprises:

a plurality of diagonal struts mechanically connected between the second longeron and the first missile tube, and wherein the diagonal struts are placed in a criss-cross pattern, and wherein ends of the diagonal struts are mechanically connected to the second longeron and the first missile tube; and a plurality of horizontal struts mechanically connected to the second longeron and the first missile tube;

3. An apparatus, as claimed in claim 2, further comprising:

a first sheet mechanically connected to the horizontal struts of the first lattice;

a second sheet mechanically connected to the horizontal struts of the second lattice;

a third sheet mechanically connected to the horizontal struts of the third lattice;

a fourth sheet mechanically connected to the horizontal struts of the fourth lattice; and a forward closure mechanically connected to the first lattice.

4. An apparatus, as claimed in claim 3, further comprising:

electrical wiring to connect to the first and second missiles, a plug electrically connected to the electrical wiring;

a safe and enable switch electrically connected to the central wiring; and a flip flop switch.

5. An apparatus, as claimed in claim 3, wherein the forward closure, comprises:

a forward end structure;

a first hinge mechanically connected to the forward end structure;

a first closure adjacent to the first missile tube and mechanically connected to the first hinge;

a second hinge mechanically connected to the forward end structure; and a second closure adjacent to the second missile tube and mechanically connected to the second hinge.

6. An apparatus, as claimed in claim 5, further comprising:

a first elastic means mechanically connected to the first closure; and a second elastic means mechanically connected to the second closure.

7. An apparatus, as claimed in claim 3, wherein the first and second missile tubes, comprise:

an outer shell of a stiff material formed in a tubular shape with an inside and outside and a length;

a shock isolation pad of a soft material forming a tubular shape with an inside and outside lining the inside of the outer shell; and an inner tube forming a tubular shape lining the inside of the shock isolation pad.

8. An apparatus, as claimed in claim 7, wherein the shock isolation pad is made of urethane and the inner tube is a silicon coating.

9. An apparatus, as claimed in claim 8, wherein the shock isolation pad has apertures, creating a honey comb shape.

10. A tubular missile holder, comprising:

an outer shell of a stiff material formed in a tubular shape with an inside and outside and a length;

a plurality of shock isolation pads of a soft material with a first side and a second side lining the inside of the outer shell with the first side adjacent to the inside of the outer shell, wherein the shock isolation pads have apertures, creating a honey comb shape; and an inner lining adjacent to the second side of the shock isolation pad, and wherein the apertures in the shock isolation pads extend from the outer shell to the inner lining.

* * * * *